US011326757B2

(12) United States Patent
Mun

(10) Patent No.: US 11,326,757 B2
(45) Date of Patent: May 10, 2022

(54) OPTICAL MODULE OF HEAD LAMP

(71) Applicant: HYUNDAI MOBIS CO., LTD., Seoul (KR)

(72) Inventor: Sun Kwon Mun, Yongin-si (KR)

(73) Assignee: Hyundai Mobis Co., Ltd., Seoul (KR)

( * ) Notice: Subject to any disclaimer, the term of this patent is extended or adjusted under 35 U.S.C. 154(b) by 0 days.

(21) Appl. No.: 17/025,613

(22) Filed: Sep. 18, 2020

(65) Prior Publication Data

US 2021/0088196 A1 Mar. 25, 2021

(30) Foreign Application Priority Data

Sep. 20, 2019 (KR) ..... 10-2019-0115925

(51) Int. Cl.
*F21S 41/365* (2018.01)
*F21S 41/255* (2018.01)
(Continued)

(52) U.S. Cl.
CPC ..... *F21S 41/365* (2018.01); *F21S 41/151* (2018.01); *F21S 41/255* (2018.01); *F21S 41/40* (2018.01);
(Continued)

(58) Field of Classification Search
CPC ..... F21S 41/151; F21S 41/153; F21S 41/255; F21S 41/26; F21S 41/265; F21S 41/27;
(Continued)

(56) References Cited

U.S. PATENT DOCUMENTS 10,232,763 B1 * 3/2019 Eckstein ..... F21S 41/663
2005/0219856 A1 * 10/2005 Tatsukawa ..... F21S 41/323 362/507
2014/0226355 A1 * 8/2014 Blandin ..... F21S 41/151 362/520
2014/0233253 A1 * 8/2014 Owada ..... F21S 41/323 362/516
(Continued)

FOREIGN PATENT DOCUMENTS

DE 102014200368 A1 * 7/2015 ..... F21S 41/143
FR 2984456 A1 * 6/2013 ..... F21S 41/26
(Continued)

OTHER PUBLICATIONS

Machine Translation of JP 2010218964A, Espacenet. (Year: 2021).*
Machine translation of JP 2010218964 A retrieved from Espacenet. (Year: 2021).*

*Primary Examiner* — Alexander K Garlen
*Assistant Examiner* — Colin J Cattanach
(74) *Attorney, Agent, or Firm* — H.C. Park & Associates, PLC

(57) ABSTRACT

An optical module of a head lamp including a first light source unit, a first reflection unit configured to concentrate, at a first focal point, light radiated from the first light source unit, a first shield unit positioned in the first focal point, second light source units, a second reflection unit configured to concentrate, at second focal points, light radiated from the second light source units, a second shield unit positioned in the second focal points, a hot zone lens unit positioned on the output side of the first shield unit and configured to form a light distribution pattern parallel to horizontal and vertical directions, by transmitting light radiated from the first shield unit, and a wide zone lens unit positioned on the output side of the second shield unit and configured to form a light distribution pattern spread in the horizontal direction, by transmitting light radiated from the second shield unit.

8 Claims, 6 Drawing Sheets

(51) Int. Cl.

| | |
|---|---|
| ***F21S 41/40*** | (2018.01) |
| ***F21S 41/151*** | (2018.01) |
| ***F21S 41/27*** | (2018.01) |
| ***F21S 41/20*** | (2018.01) |
| ***F21S 41/43*** | (2018.01) |
| ***F21S 41/153*** | (2018.01) |
| ***F21S 41/36*** | (2018.01) |
| ***F21S 41/26*** | (2018.01) |
| ***F21S 41/265*** | (2018.01) |

(52) U.S. Cl.
CPC ..... *F21S 41/153* (2018.01); *F21S 41/26* (2018.01); *F21S 41/265* (2018.01); *F21S 41/27* (2018.01); *F21S 41/285* (2018.01); *F21S 41/36* (2018.01); *F21S 41/43* (2018.01)

(58) Field of Classification Search
CPC ..... F21S 41/285; F21S 41/36; F21S 41/40; F21S 41/43
See application file for complete search history.

(56) References Cited

U.S. PATENT DOCUMENTS

| | | | | |
|---|---|---|---|---|
| 2015/0300588 | A1* | 10/2015 | Wang | F21S 41/147<br>362/516 |
| 2017/0284620 | A1* | 10/2017 | Arai | F21S 41/192 |
| 2017/0292668 | A1* | 10/2017 | Arai | F21S 45/47 |
| 2018/0066820 | A1* | 3/2018 | Yamamoto | F21S 41/148 |
| 2018/0087732 | A1* | 3/2018 | De Lamberterie | B60Q 1/16 |
| 2019/0093846 | A1* | 3/2019 | Gromfeld | F21S 41/322 |
| 2019/0331309 | A1* | 10/2019 | Kuwata | F21S 41/265 |
| 2020/0025349 | A1* | 1/2020 | Warner | F21S 41/25 |

FOREIGN PATENT DOCUMENTS

| | | | | |
|---|---|---|---|---|
| JP | 2010218964 | A * | 9/2010 | F21S 41/148 |
| JP | 2014127329 | A * | 7/2014 | F21S 41/265 |
| KR | 10-1713159 | | 3/2017 | |
| WO | WO-2014084004 | A1 * | 6/2014 | F21S 41/265 |
| WO | WO-2020025171 | A1 * | 2/2020 | F21S 41/26 |

* cited by examiner

OPTICAL MODULE OF HEAD LAMP

CROSS-REFERENCE TO RELATED APPLICATION

This application claims priority from and the benefit of Korean Patent Application No. 10-2019-0115925, filed on Sep. 20, 2019, which is hereby incorporated by reference for all purposes as if set forth herein.

BACKGROUND

Field

Exemplary embodiments relate to an optical module of a head lamp, and more particularly, to an optical module of a head lamp, which can reduce the size and weight, and the height of a lens.

Discussion of the Background

In general, head lamps are installed on both sides at the front of a vehicle. The head lamp is equipped with a low beam light source unit and a high beam light source unit. The head lamp implements an optical function capable of forming a specific pattern around the vehicle or on a road surface.

The head lamp includes a reflector for reflecting light radiated from an LED and a shield unit for separating, into a low beam and a high beam, light reflected by the reflector. The low beam and the high beam are radiated to the front of the vehicle through an aspheric lens.

In a conventional technology, however, an implementation of the design of a head lamp has its limit because a light distribution pattern is formed by applying the aspheric lens having a short focus to the head lamp.

Furthermore, in order to implement a slim image, the top and bottom of the aspheric lens are cut and used. In this case, the size and weight of an optical module may be increased because the thickness of an optical lens is increased as the diameter of the aspheric lens is increased.

The Background Technology of the present disclosure is disclosed in Korean Patent No. 1713159 (published on Mar. 7, 2017) entitled "HEAD LAMP FOR VEHICLES."

The above information disclosed in this Background section is only for enhancement of understanding of the background of the invention and, therefore, it may contain information that does not constitute prior art.

SUMMARY

Various embodiments are directed to an optical module of a head lamp, which can be reduced in size and weight and reduce the height of a lens unit.

Additional features of the invention will be set forth in the description which follows, and in part will be apparent from the description, or may be learned by practice of the invention.

An exemplary embodiment of the present invention provides an optical module of a head lamp including a first light source unit, a first reflection unit configured to concentrate, at a first focal point, light radiated from the first light source unit, a first shield unit positioned in the first focal point, a plurality of second light source units, a second reflection unit configured to concentrate, at a plurality of second focal points, pieces of light radiated from the plurality of second light source units, a second shield unit positioned in the plurality of second focal points, a hot zone lens unit positioned on an output side of the first shield unit and configured to form a light distribution pattern parallel to a horizontal direction and a vertical direction, by transmitting light radiated from the first shield unit, and a wide zone lens unit positioned on an output side of the second shield unit and configured to form a light distribution pattern spread in the horizontal direction, by transmitting light radiated from the second shield unit.

The hot zone lens unit and the wide zone lens unit may be integrated.

The hot zone lens unit and the wide zone lens unit may be disposed in parallel in the horizontal direction.

A hot zone output surface unit of the hot zone lens unit and a wide zone output surface unit of the wide zone lens unit may be formed to have the same curvature in the horizontal direction.

A hot zone incidence surface unit of the hot zone lens unit may be convexly formed toward the first shield unit.

The width of the wide zone lens unit may be gradually decreased as the wide zone lens unit becomes distant from the hot zone lens unit.

The first reflection unit may include one first reflection surface for forming the one first focal point on the first shield unit. The first light source unit may include one first light source positioned in the first reflection surface.

The first reflection unit may include a plurality of first reflection surfaces for forming the one first focal point on the first shield unit. The first light source unit may include a plurality of first light sources positioned on the first reflection surfaces, respectively.

The second reflection unit may include a plurality of second reflection surfaces for forming the plurality of second focal points on the second shield unit. The second light source unit may include a plurality of second light sources positioned on the second reflection surfaces, respectively.

The plurality of second reflection surfaces may be aligned in parallel with the length direction of the second shield unit.

The second reflection unit may include one second reflection surface for forming the plurality of second focal points on the second shield unit. The second light source unit may include a plurality of second light sources aligned in the second reflection surface.

The second reflection surface may be aligned in parallel with the length direction of the second shield unit.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
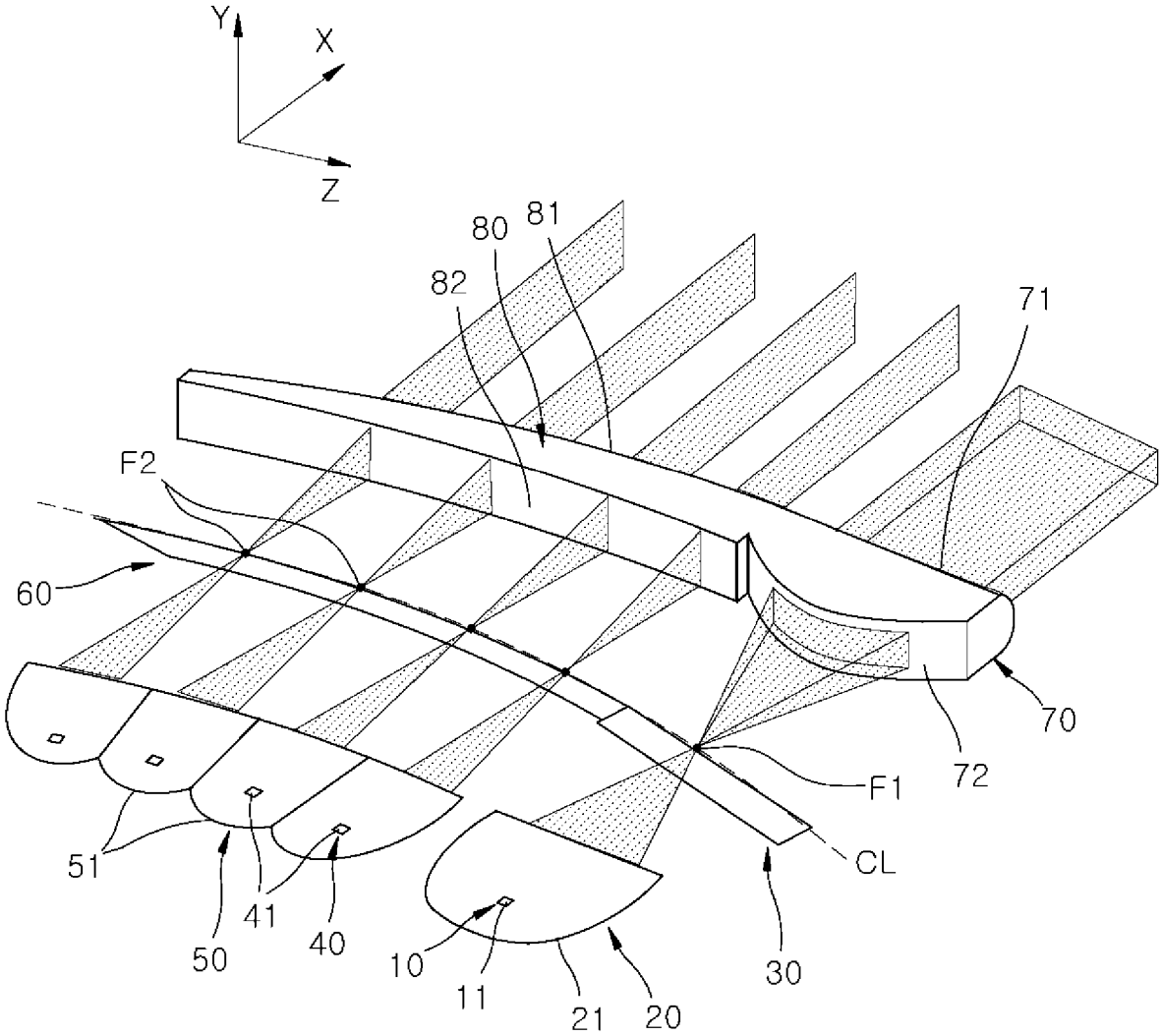
FIG. 1 is a perspective view illustrating an optical module of a head lamp according to a first embodiment.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. Like reference numerals in the drawings denote like elements.

Unless defined otherwise, it is to be understood that all the terms (including technical and scientific terms) used in the specification has the same meaning as those that are understood by those who skilled in the art. Further, the terms defined by the dictionary generally used should not be ideally or excessively formally defined unless clearly defined specifically. It will be understood that for purposes of this disclosure, "at least one of X, Y, and Z" can be construed as X only, Y only, Z only, or any combination of two or more items X, Y, and Z (e.g., XYZ, XYY, YZ, ZZ). Unless particularly described to the contrary, the term "comprise", "configure", "have", or the like, which are described herein, will be understood to imply the inclusion of the stated components, and therefore should be construed as including other components, and not the exclusion of any other elements.

Hereinafter, an optical module of a head lamp will be described below with reference to the accompanying drawings through various exemplary embodiments.

The thickness of lines or the size of elements illustrated in the drawings in a process of describing an optical module of a head lamp may have been exaggerated for the clarity of a description and for convenience' sake. Terms to be described below have been defined by taking into consideration their functions in the present disclosure, and may be different depending on a user or operator's intention or practice. Accordingly, such terms should be interpreted based on the overall contents of this specification.

First, an optical module of a head lamp according to a first embodiment is described.

Figure 2:
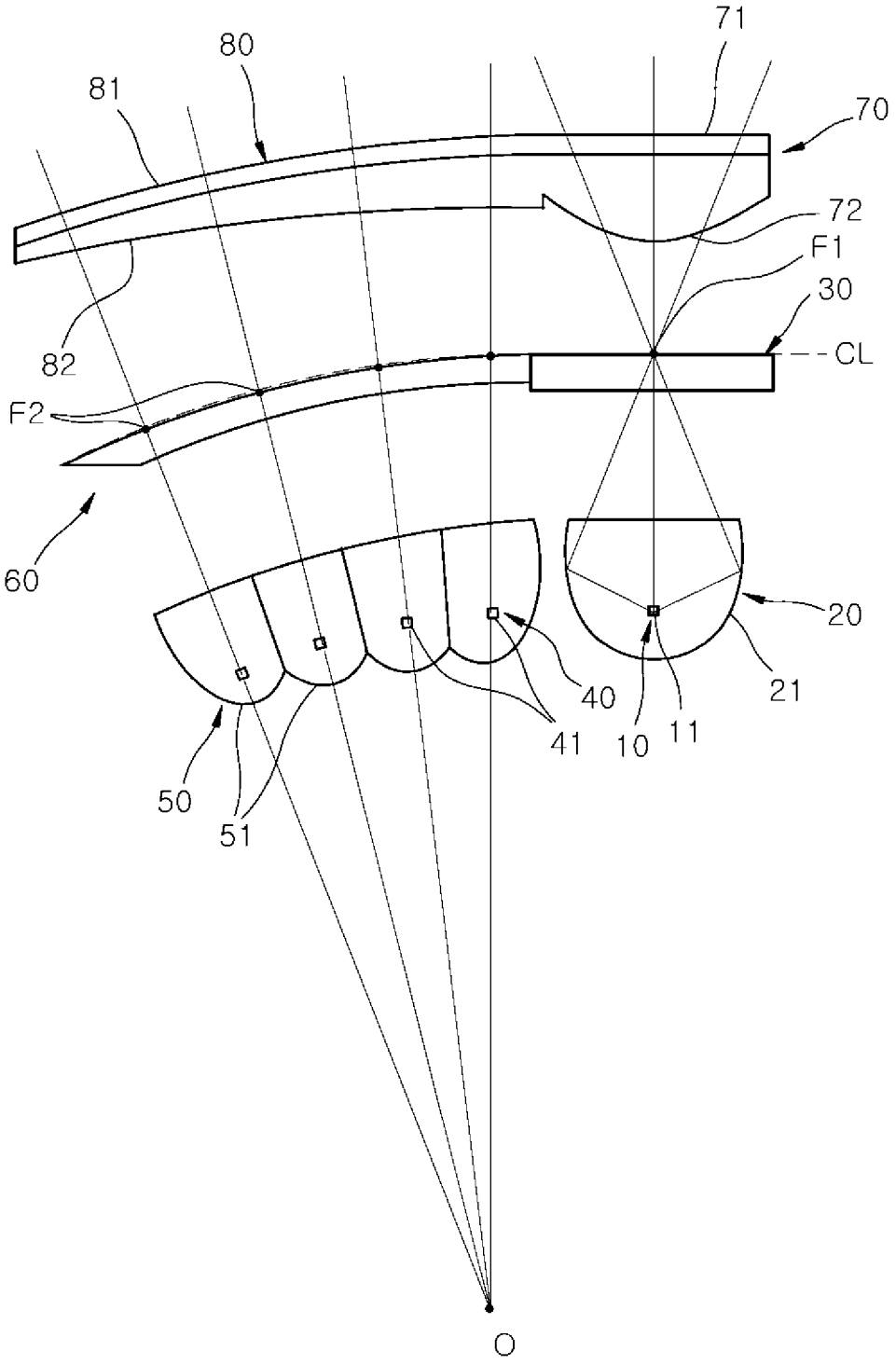
FIG. 2 is a plan view illustrating the optical module of a head lamp according to the first embodiment.
Figure 3:
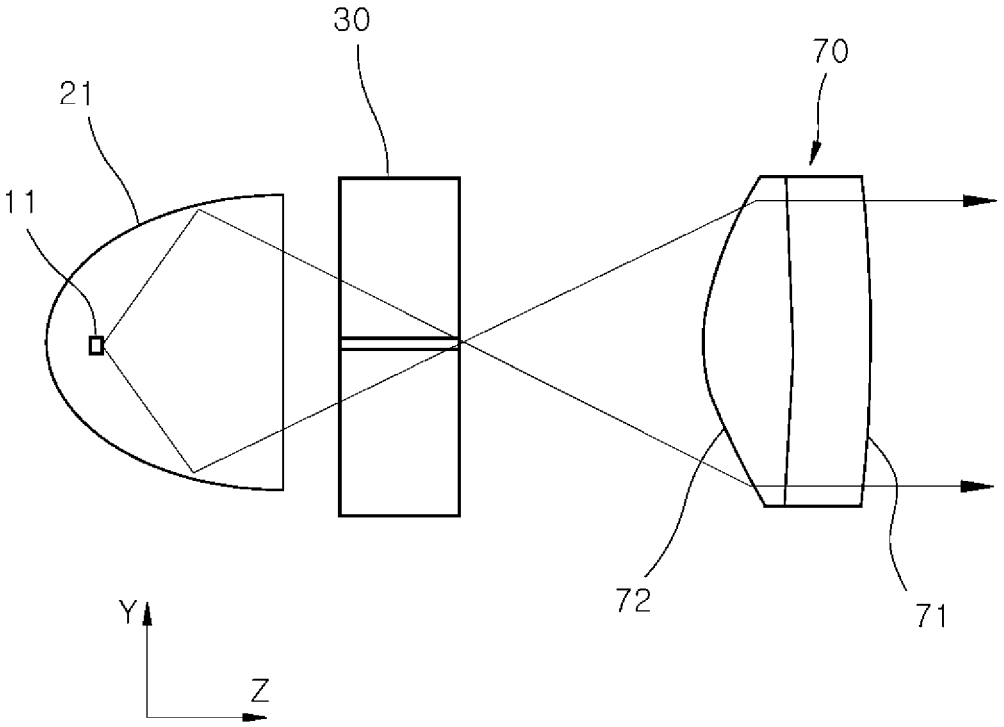
FIG. 3 is a side view illustrating the state in which a first light source unit radiates light to a hot zone lens unit in the optical module of a head lamp according to the first embodiment.

FIG. 1 is a perspective view illustrating the optical module of a head lamp according to the first embodiment. FIG. 2 is a plan view illustrating the optical module of a head lamp according to the first embodiment. FIG. 3 is a side view illustrating the state in which a first light source unit radiates light to a hot zone lens unit in the optical module of a head lamp according to the first embodiment.

Referring to FIGS. 1 to 3, the optical module of a head lamp according to the first embodiment includes a first light source unit 10, a first reflection unit 20, a first shield unit 30, a second light source unit 40, a second reflection unit 50, a second shield unit 60, a hot zone lens unit 70, and a wide zone lens unit 80.

The first light source unit 10 radiates light so that the light is concentrated at a first focal point F1. A first LED device may be applied as the first light source unit 10.

The first reflection unit 20 concentrates light, radiated from the first light source unit 10, at the first focal point F1. In this case, the first reflection unit 20 includes one first reflection surface 21 for forming one first focal point F1 on the first shield unit 30. The first light source unit 10 includes one first light source 11 positioned in the first reflection surface 21.

The first shield unit 30 is positioned at the first focal point F1. The first shield unit 30 is positioned between the first light source unit 10 and the hot zone lens unit 70. A cutoff line CL for limiting light radiated from the first light source unit 10 is formed at the end of the first shield unit 30.

A plurality of the second light source units 40 radiates a plurality of pieces of light so that the plurality of pieces of light is concentrated at a plurality of second focal points F2, respectively. A second LED device may be applied as the second light source unit 40. The plurality of second light source units 40 is aligned in parallel with a horizontal direction (i.e., Z axis). The plurality of second focal points F2 is aligned in parallel in the horizontal direction (i.e., Z axis).

The second reflection unit 50 concentrates light, radiated from the second light source unit 40, at the plurality of second focal points F2. The second reflection unit 50 is elongated in the horizontal direction (i.e., Z axis).

The second shield unit 60 is positioned at the plurality of second focal points F2. The second shield unit 60 is elongated in the horizontal direction (i.e., Z axis) so that the plurality of second focal points F2 is aligned. The second shield unit 60 is positioned in parallel with the second reflection unit 50. The second shield unit 60 is positioned between the second light source unit 40 and the wide zone lens unit 80. The first shield unit 30 and the second shield unit 60 form one cutoff line CL connected in a curve form having given curvature.

The hot zone lens unit 70 is positioned on the output side of the first shield unit 30. When light radiated from the first shield unit 30 passes through the hot zone lens unit 70, the hot zone lens unit 70 forms a light distribution pattern parallel to the horizontal direction (i.e., Z axis) and a vertical direction (i.e., Y axis). The hot zone lens unit 70 forms a single focus having the same focus in both the horizontal direction (i.e., Z axis) and the vertical direction (i.e., Y axis) by collecting light toward the front side of a vehicle so that the light is radiated to a long distance. The light concentrated at the first focal point F1 passes through the hot zone lens unit 70, thus forming a light distribution pattern parallel to the horizontal direction (i.e., Z axis) and the vertical direction (i.e., Y axis). Accordingly, the light radiated from the hot zone lens unit 70 may be radiated to a long distance. Furthermore, light that deviates from the first focal point F1 passes through the hot zone lens unit 70 and is slantly spread and output in the horizontal direction (i.e., Z axis) and the vertical direction (i.e., Y axis).

The wide zone lens unit 80 is positioned on the output side of the second shield unit 60, and transmits pieces of light radiated from the second shield unit 60, thus forming a light distribution pattern in the horizontal direction (i.e., Z axis). The wide zone lens unit 80 forms a light distribution pattern having a straight line form in which pieces of light concentrated at the plurality of second focal points F2 are parallel to the horizontal direction (i.e., Z axis). In this case, the pieces of light reflected by the second reflection unit 50 and concentrated at the plurality of second focal points F2 form the light distribution pattern parallel in the vertical direction (i.e., Y axis) while passing through the wide zone lens unit 80. Light that is reflected by the second reflection unit 50 and that deviates from the second focal point F2 is slantly spread in the horizontal direction (i.e., Z axis) while passing through the wide zone lens unit 80. Accordingly, in the wide zone lens unit 80, light is naturally spread in the horizontal direction (i.e., Z axis).

The ratio of the lengths of the hot zone lens unit 70 and the wide zone lens unit 80 may be variously changed. For example, the ratio of the lengths of the hot zone lens unit 70 and the wide zone lens unit 80 may be 3:7. Furthermore, the ratio of the lengths of the hot zone lens unit 70 and the wide zone lens unit 80 may be adjusted within a range of 2:8 to 8:2. As the length of the hot zone lens unit 70 is increased, maximum long-distance performance and short distance illuminance of light may be increased, but a maximum light width and turning visibility of light may be decreased. Furthermore, as the length of the wide zone lens unit 80 is increased, maximum long-distance performance and short distance illuminance of light may be decreased, but a maximum light width and turning visibility of light may be increased. Accordingly, the ratio of the lengths of the hot zone lens unit 70 and the wide zone lens unit 80 may be properly controlled by taking into consideration maximum long-distance performance, short distance illuminance, a light width and turning visibility necessary for a vehicle.

In this case, the maximum long-distance performance means that illuminance necessary at a distance of about 90 to 100 m toward the front side of a vehicle is satisfied. The short distance illuminance means that illuminance necessary at a distance of 10 to 30 m toward the front side of a vehicle is satisfied. Furthermore, the maximum light width means a maximum width of light spread in the width direction of a vehicle. The turning visibility means that light is radiated to the turning side of a vehicle so that a driver can view the turning side of the vehicle when the vehicle is turned. The maximum long-distance performance, the short distance illuminance, the maximum light width, and the turning visibility may be variously designed depending on requirements for a vehicle.

The hot zone lens unit 70 and the wide zone lens unit 80 are integrated. Accordingly, the number of parts of the optical module of a head lamp can be reduced. Furthermore, the size and weight of the optical module of a head lamp and the height of the lens units 70 and 80 can be reduced.

The hot zone lens unit 70 and the wide zone lens unit 80 are disposed in parallel in the horizontal direction (i.e., Z axis). Accordingly, when a vehicle is turned to the left or right, a maximum light width and turning visibility can be improved by light radiated from the wide zone lens unit 80. Furthermore, a slim image can be easily implemented by a head lamp.

A hot zone output surface unit 71 of the hot zone lens unit 70 and a wide zone output surface unit 81 of the wide zone lens unit 80 are formed to have the same curvature in the horizontal direction (i.e., Z axis). Since the hot zone output surface unit 71 and the wide zone output surface unit 81 are formed to have the same curvature in the horizontal direction (i.e., Z axis), the lens units 70 and 80 having no sense of alienation and forming a single curved surface can be designed by applying the optically same conic value, radius and aspherical surface coefficient value to the lens units 70 and 80.

A hot zone incidence surface unit 72 of the hot zone lens unit 70 is convexly formed toward the first shield unit 30. Since the hot zone incidence surface unit 72 is convexly formed toward the first shield unit 30, the hot zone lens unit 70 can be optically designed so that light incident from the first focal point F1 to the hot zone lens unit 70 is output toward the front side of a vehicle almost in parallel. Accordingly, light radiated from the hot zone lens unit 70 can sufficiently implement maximum long-distance arrival performance and short distance illuminance of a vehicle.

The width of the wide zone lens unit 80 is gradually decreased as the wide zone lens unit 80 becomes distant from the hot zone lens unit 70. In the wide zone lens unit 80, a flaring angle of light in the vertical direction (i.e., Y axis) may be gradually increased as the wide zone lens unit 80 becomes distant from the hot zone lens unit 70. A wide zone incidence surface unit 82 of the wide zone lens unit 80 is elongated in the horizontal direction (i.e., Z axis).

The first reflection unit 20 includes the one first reflection surface 21 for forming one first focal point F1 on the first shield unit 30. The first light source unit 10 includes the one first light source 11 positioned in the first reflection surface 21. In this case, the left and right sides of the hot zone lens unit 70 and the focal distance of the first reflection surface 21 may be changed by taking performance of the hot zone lens unit 70 into consideration. In the first reflection unit 20, light concentrated at the first focal point F1 passes through the hot zone lens unit 70, and is output as horizontal light (i.e., light parallel to the X axis). Light that deviates from the first focal point F1 passes through the hot zone lens unit 70, and is slantly spread with respect to the vertical direction (i.e., Y axis) and the horizontal direction (i.e., Z axis). A hot zone flaring angle of the hot zone lens unit 70 is limited by the size of the hot zone lens unit 70 in the horizontal direction (i.e., Z axis).

The second reflection unit 50 includes a plurality of second reflection surfaces 51 for forming the plurality of second focal points F2 on the second shield unit 60. The second light source unit 40 includes a plurality of second light sources 41 installed on the second reflection surfaces 51, respectively.

Optical performance and the uniformity of a light distribution pattern can be controlled because a rotation angle of the second reflection surface 51 and a focal distance of the second reflection surface 51 are individually controlled.

In this case, the plurality of second reflection surfaces 51 is aligned in parallel with the length direction of the second shield unit 60. Accordingly, pieces of light reflected by the plurality of second reflection surfaces 51 may form a plurality of second focal points F2 on the second shield unit 60 in a row.

An optical module of a head lamp according to a second embodiment is described below. The optical module of the second embodiment is substantially the same as that of the first embodiment except forms of the first light source unit and the first reflection unit. Accordingly, characteristics units of the second embodiment are described, and the same elements as those of the first embodiment are assigned the same reference numerals.

Figure 4:
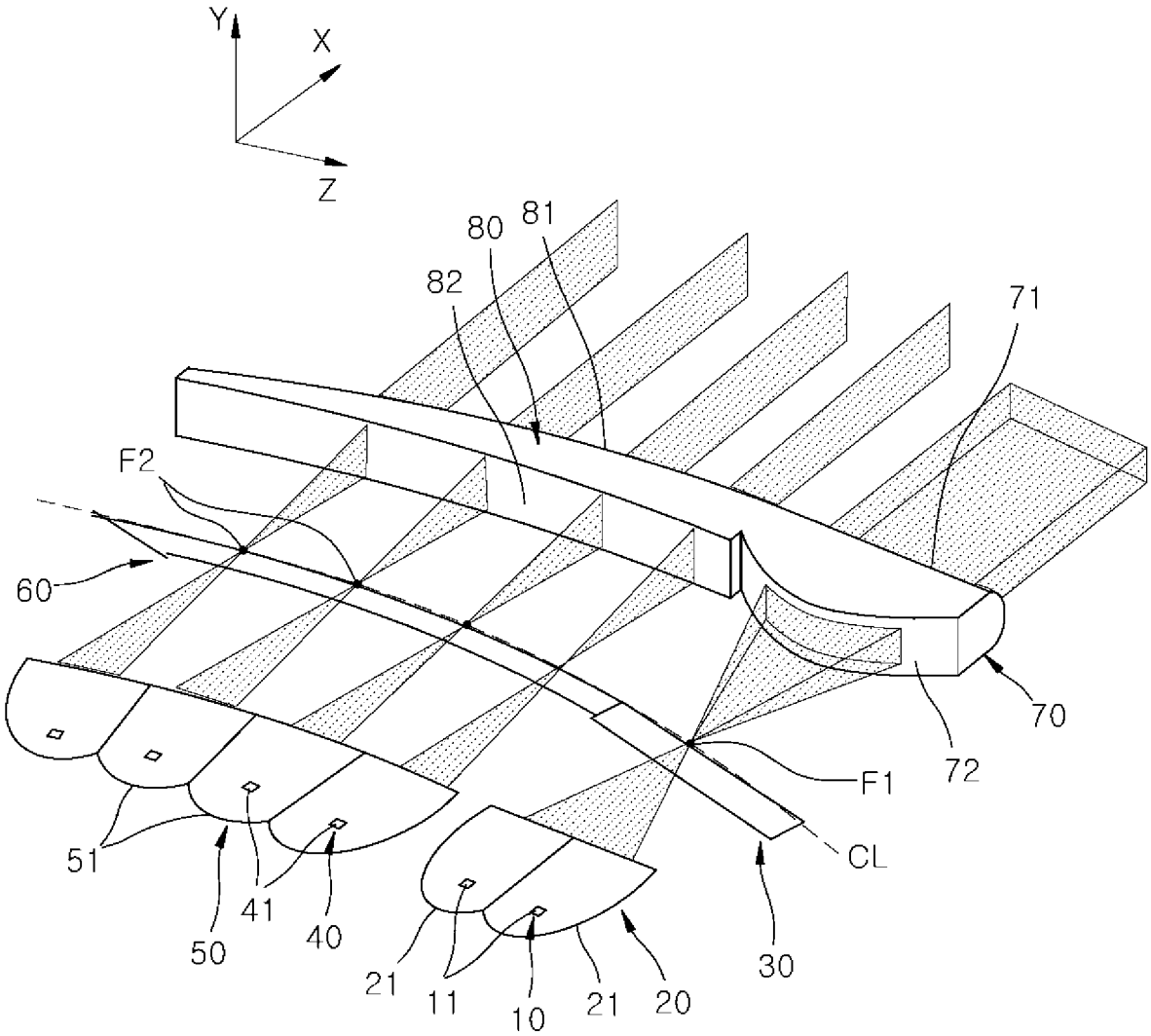
FIG. 4 is a perspective view illustrating an optical module of a head lamp according to a second embodiment.
Figure 5:
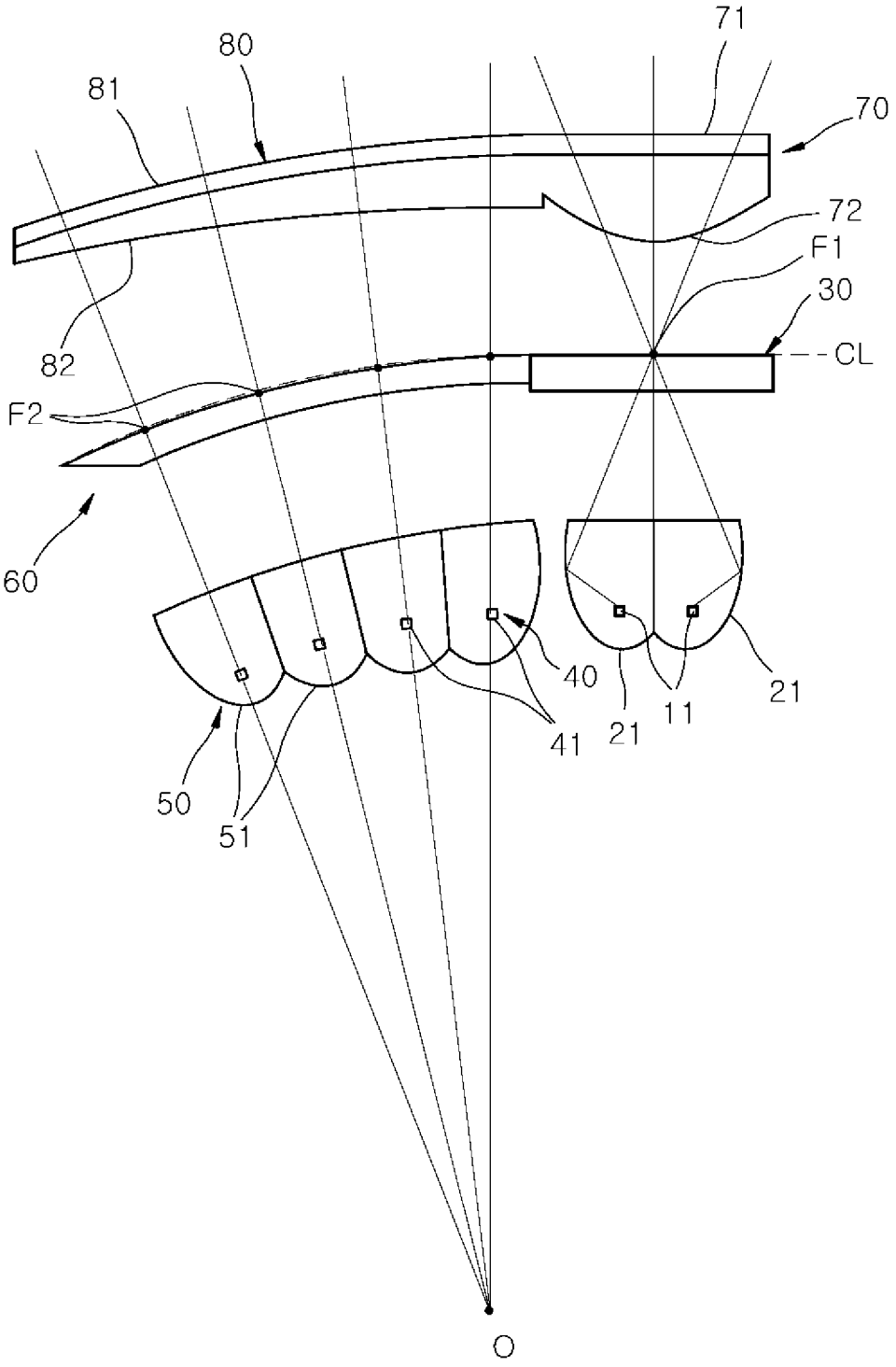
FIG. 5 is a plan view illustrating the optical module of a head lamp according to the second embodiment.

FIG. 4 is a perspective view illustrating the optical module of a head lamp according to the second embodiment. FIG. 5 is a plan view illustrating the optical module of a head lamp according to the second embodiment.

Referring to FIGS. 4 and 5, in the optical module of a head lamp according to the second embodiment, a first reflection unit 20 includes a plurality of first reflection surfaces 21 for forming one first focal point F1 on a first shield unit 30. The first light source unit 10 includes a plurality of first light sources 11 positioned in the first reflection surfaces 21, respectively.

In this case, the focal distance and spread area of the first reflection unit 20 may be controlled based on the sizes of the first reflection unit 20 and a hot zone lens unit 70. In the second embodiment, since the plurality of first reflection surfaces 21 and the plurality of first light sources 11 are disposed, the location and angle of the first reflection surface 21 may be controlled in order to increase the center luminosity and flaring angle of light in the hot zone lens unit 70. Furthermore, in order to control the flaring angle of light, a reflection surface for the flaring angle is applied, the focus of the reflection surface is designated to deviate from the first focal point F1 by a given distance, and a focal distance is controlled so that a plurality of light clumps does not occur by controlling a reflection surface for a hot spot and a reflection surface for a flaring angle increase.

Furthermore, since the plurality of first reflection surfaces 21 is applied to a narrow area of the first reflection unit 20, the flaring angle may be reduced and luminosity and light efficiency may be degraded due to damage to a unique characteristic of each of the first reflection surfaces 21. In this case, light efficiency and a clump of light can be improved by fabricating the plurality of first reflection surfaces 21 to be optically turned around the first light source unit 10, and a loss of maximum luminosity can be reduced by moving the focal distances of the plurality of first reflection surfaces 21.

An optical module of a head lamp according to a third embodiment is described below. The optical module of the third embodiment is substantially the same as that of the first embodiment except forms of the second light source unit and the second reflection unit. Accordingly, characteristics units of the third embodiment are described, and the same elements as those of the first embodiment are assigned the same reference numerals.

Figure 6:
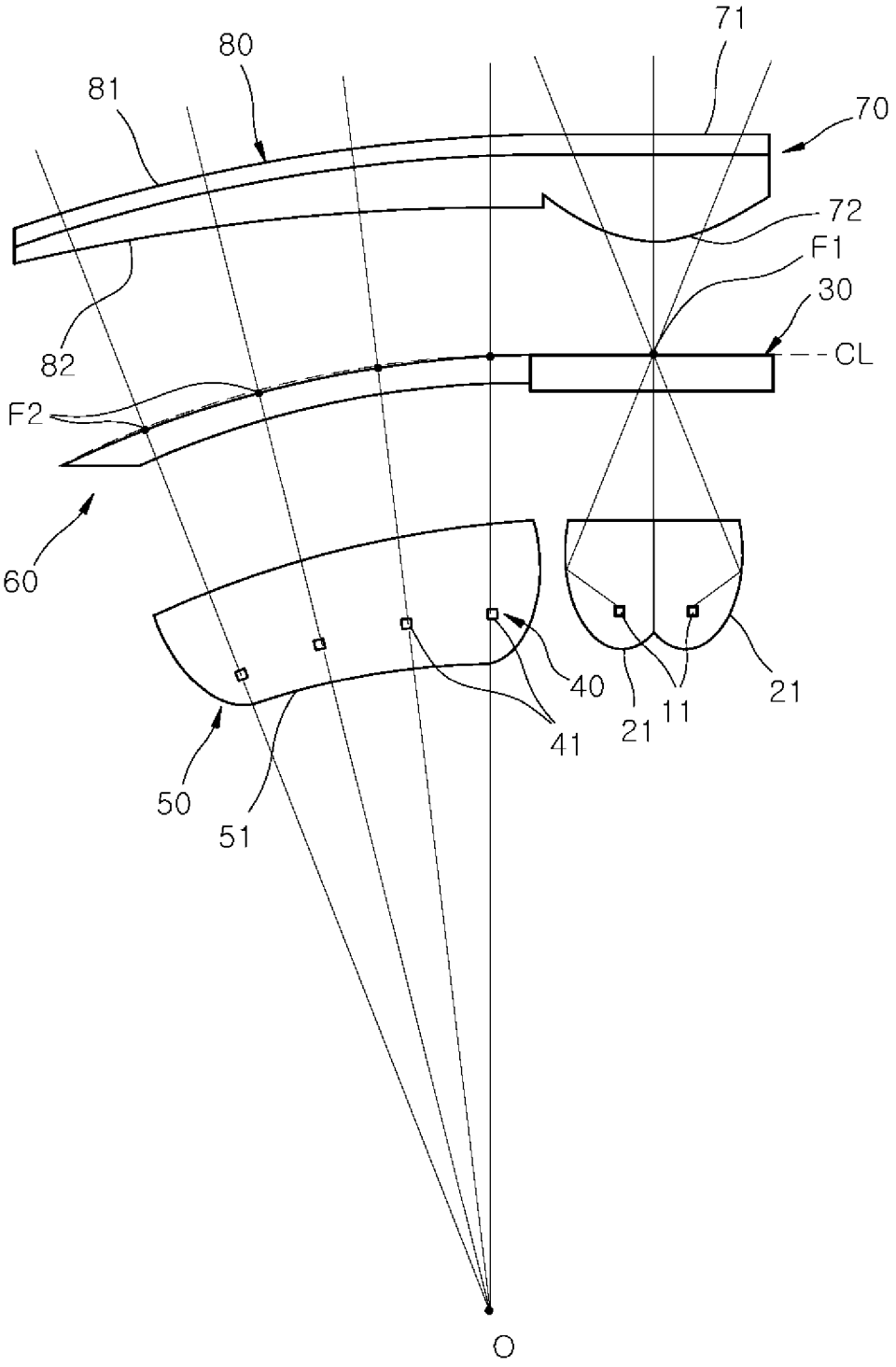
FIG. 6 is a plan view illustrating an optical module of a head lamp according to a third embodiment.

FIG. 6 is a plan view illustrating the optical module of a head lamp according to the third embodiment.

Referring to FIG. 6, in the optical module of a head lamp according to the third embodiment, a second reflection unit 50 includes one second reflection surface 51 for forming a plurality of second focal points F2 on a second shield unit 60. A second light source unit 40 includes a plurality of second light sources 41 aligned in the second reflection surface 51.

In the third embodiment, since the plurality of second light sources 41 is aligned in the one second reflection surface 51, a problem, such as a bouncing phenomenon of light, can be improved because the stagnation of a deposition solution is prevented when the second reflection surface 51 is fabricated by depositing the deposition agent. The bouncing phenomenon of light means a phenomenon in which light significantly looks bright in a portion where the deposition agent is stagnated.

Furthermore, if the reference line of the second reflection surface 51 in the vertical direction (i.e., Y axis) is ovally formed and the reference line of the second reflection surface 51 in the horizontal direction (i.e., Z axis) is designed in a multi-focal reflector form, the uniformity of light on a road surface and optical performance can be controlled more easily because a light path is easily controlled.

According to an embodiment, light radiated from the hot zone lens unit can be radiated to a long distance because pieces of light concentrated at the first focal point pass through the hot zone lens unit and form a light distribution pattern parallel to the horizontal direction and the vertical direction.

Furthermore, according to an embodiment, pieces of light reflected by the second reflection unit and concentrated at the second focal point form a light distribution pattern parallel in the vertical direction while passing through the wide zone lens unit, and light that is reflected by the second reflection unit and deviates from the second focal point is slantly spread in the horizontal direction while passing through the wide zone lens unit and. Accordingly, in the wide zone lens unit, light is naturally spread in the horizontal direction.

Furthermore, according to an embodiment, the number of parts of the optical module of a head lamp can be reduced because the hot zone lens unit and the wide zone lens unit are integrated.

Furthermore, the size and weight of the optical module and the height of the lens unit can be reduced because a common aspheric lens having a short focus need not be installed.

Although exemplary embodiments of the disclosure have been disclosed for illustrative purposes, those skilled in the art will appreciate that various modifications, additions and substitutions are possible, without departing from the scope and spirit of the disclosure as defined in the accompanying claims. Thus, the true technical scope of the disclosure should be defined by the following claims.

What is claimed is:

1. An optical module of a head lamp, comprising:

a first light source unit;

a first reflection unit configured to concentrate, at a first focal point, light radiated from the first light source unit;

a first shield unit positioned at the first focal point;

a plurality of second light source units;

a second reflection unit configured to concentrate, at a plurality of second focal points, pieces of light radiated from the plurality of second light source units;

a second shield unit positioned at the plurality of second focal points;

a hot zone lens unit positioned on an output side of the first shield unit and configured to form a light distribution pattern parallel to a horizontal direction and a vertical direction, by transmitting light radiated from the first shield unit; and a wide zone lens unit positioned on an output side of the second shield unit and configured to form a light distribution pattern spread in the horizontal direction, by transmitting light radiated from the second shield unit, wherein:

a hot zone incidence surface unit of the hot zone lens unit is convexly formed toward the first shield unit;

an entire wide zone incidence surface unit of the wide zone lens unit has a continuously-curved surface shape which is different than that of the hot zone incidence surface unit;

the hot zone lens unit and the wide zone lens unit are integrated with each other and disposed in parallel in the horizontal direction; and a hot zone output surface unit of the hot zone lens unit and a wide zone output surface unit of the wide zone lens unit have identical curvature in the horizontal direction.

2. The optical module of claim 1, wherein a width of the wide zone lens unit is gradually decreased as the wide zone lens unit becomes distant from the hot zone lens unit.

3. The optical module of claim 1, wherein:

the first reflection unit comprises one first reflection surface for forming the one first focal point on the first shield unit; and the first light source unit comprises one first light source positioned in the first reflection surface.

4. The optical module of claim 1, wherein:

the first reflection unit comprises a plurality of first reflection surfaces for forming the one first focal point on the first shield unit; and the first light source unit comprises a plurality of first light sources positioned on the first reflection surfaces, respectively.

5. The optical module of claim 1, wherein:

the second reflection unit comprises a plurality of second reflection surfaces for forming the plurality of second focal points on the second shield unit; and the second light source unit comprises a plurality of second light sources positioned on the second reflection surfaces, respectively.

6. The optical module of claim 5, wherein the plurality of second reflection surfaces is aligned in parallel with a length direction of the second shield unit.

7. The optical module of claim 1, wherein:

the second reflection unit comprises one second reflection surface for forming the plurality of second focal points on the second shield unit; and the second light source unit comprises a plurality of second light sources aligned in the second reflection surface.

8. The optical module of claim 7, wherein the second reflection surface is aligned in parallel with a length direction of the second shield unit.

* * * * *